US010247186B2

(12) United States Patent
Moriglia et al.

(10) Patent No.: US 10,247,186 B2
(45) Date of Patent: Apr. 2, 2019

(54) VARIABLE LUBRICANT VANE PUMP

(71) Applicant: PIERBURG PUMP TECHNOLOGY GMBH, Neuss (DE)

(72) Inventors: Maurizio Moriglia, Mondovi (IT); Nicola Celata, Leghorn (IT); Bernardo Celata, Leghorn (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 333 days.

(21) Appl. No.: 14/897,647

(22) PCT Filed: Jun. 13, 2013

(86) PCT No.: PCT/EP2013/062277
§ 371 (c)(1),
(2) Date: Dec. 11, 2015

(87) PCT Pub. No.: WO2014/198322
PCT Pub. Date: Dec. 18, 2014

(65) Prior Publication Data

US 2016/0138592 A1 May 19, 2016

(51) Int. Cl.
*F04C 14/06* (2006.01)
*F04C 2/344* (2006.01)
(Continued)

(52) U.S. Cl.
CPC ..... *F04C 14/06* (2013.01); *F01M 1/02* (2013.01); *F04C 2/3442* (2013.01);
(Continued)

(58) Field of Classification Search
CPC ..... F04C 2/3442; F04C 14/22; F04C 14/24; F04C 14/26; F04C 14/223; F04C 2210/14
See application file for complete search history.

(56) References Cited

U.S. PATENT DOCUMENTS

2006/0104823 A1 5/2006 Hunter et al.
2007/0224067 A1 9/2007 Arnold et al.
(Continued)

FOREIGN PATENT DOCUMENTS

CN 101392747 A 3/2009
CN 101443557 A 5/2009
(Continued)

*Primary Examiner* — Kenneth J Hansen
(74) *Attorney, Agent, or Firm* — Norman B. Thot

(57) ABSTRACT

A variable lubricant vane pump which provides a pressurized lubricant for an engine includes a pump housing comprising a pump chamber. The pump chamber comprises pump compartments which rotate from a charge zone to a discharge zone. The pressurized lubricant is discharged from the pump compartments into an outlet cavity. A control ring envelopes the pump chamber and shifts between high and a low pumping volume position. A pump rotor comprises radially slidable vanes which rotate in the control ring. A pressure control chamber pushes the control ring into the high pumping volume direction. A control valve connects or disconnects the pressure control chamber to a lubricant tank. A pilot chamber pushes the control ring into the low pumping volume direction. A pilot chamber channel connects the outlet cavity with the pilot chamber. A control chamber channel connects the outlet cavity with the pressure control chamber.

7 Claims, 2 Drawing Sheets

(51) Int. Cl.
*F04C 14/22* (2006.01)
*F01M 1/02* (2006.01)

(52) U.S. Cl.
CPC ... *F04C 14/223* (2013.01); *F01M 2001/0238* (2013.01); *F04C 2210/206* (2013.01)

(56) References Cited

U.S. PATENT DOCUMENTS

| | | | | |
|---|---|---|---|---|
| 2008/0187446 | A1* | 8/2008 | Staley | F04C 2/3442 417/220 |
| 2009/0081052 | A1 | 3/2009 | Soeda et al. | |
| 2013/0022485 | A1 | 1/2013 | Hunter et al. | |
| 2013/0039790 | A1 | 2/2013 | Cuneo et al. | |
| 2013/0112174 | A1* | 5/2013 | Krauss | F02M 63/025 123/504 |
| 2013/0263815 | A1 | 10/2013 | Cuneo | |
| 2014/0030120 | A1 | 1/2014 | Cuneo | |

FOREIGN PATENT DOCUMENTS

| | | | | |
|---|---|---|---|---|
| EP | 1 790 855 | A2 | 5/2007 | |
| JP | 57-131890 | A | 8/1982 | |
| JP | 2000-104672 | A | 4/2000 | |
| JP | 2011-179485 | A | 9/2011 | |
| WO | WO 2011/107156 | A1 | 9/2011 | |
| WO | WO 2012/069083 | A1 | 5/2012 | |
| WO | WO 2012069083 | A1 * | 5/2012 | F04C 2/3442 |
| WO | WO 2012/113437 | A1 | 8/2012 | |

* cited by examiner

VARIABLE LUBRICANT VANE PUMP

CROSS REFERENCE TO PRIOR APPLICATIONS

This application is a U.S. National Phase application under 35 U.S.C. § 371 of International Application No. PCT/EP2013/062277, filed on Jun. 13, 2013. The International Application was published in English on Dec. 18, 2014 as WO 2014/198322 A1 under PCT Article 21(2).

FIELD

The present invention relates to a mechanical variable lubricant vane pump for providing pressurized lubricant for an internal combustion engine.

BACKGROUND

A mechanical lubricant vane pump, as described in WO 2011/107156 A1, is generally a volumetric pump which is mechanically driven by an engine so that the pump rotates with a rotational speed which is proportional to the engine's rotational speed. The lubricant vane pump is provided with a pump rotor body holding radially slidable vanes rotating inside a shiftable control ring. The slidable vanes, the rotor body, and the control ring wall define a plurality of rotating pump compartments which rotate within a pump chamber to thereby pump the lubricant from an inlet cavity to an outlet cavity of the pump.

The control ring is shiftable with respect to the rotor axis between a high pumping volume position with high eccentricity, and a low pumping volume position with low eccentricity, so that the lubricant volume per rotation pumped by the pump can be adapted to keep the discharge pressure of the pump at a constant level. The eccentricity position of the control ring with respect to the rotational axis of the pump rotor is determined by two counter acting hydraulic chambers, i.e., the pressure control chamber for pushing the control ring into a high pumping volume direction and the pilot chamber for pushing the control ring into a low pumping volume direction against the pressure control chamber. Both chambers are fluidically connected to the outlet cavity by respective fluidic channels.

The pilot chamber is connected to the outlet cavity by a pilot chamber channel with a large cross-section so that the fluidic resistance is low. The control chamber is connected to the outlet cavity by a relatively long control chamber channel with a pressure throttle valve in the course of the control chamber channel. The fluidic pressure in the control chamber is controlled by a control valve which allows the pressure control chamber to be connected or disconnected to a lubricant tank which is under atmospheric pressure. The control valve itself is controlled by the discharge pressure of the pump or by the effective lubricant pressure in or at the engine.

After a cold start of the engine, the pilot chamber of the pump is filled relatively quickly with the cold and viscous lubricant because the fluidic resistance between the outlet cavity and the pilot chamber is relatively low. The control ring is thereby pushed into the low pumping volume direction right after the engine's cold start. In contrast to the pilot chamber, it takes a while until the control chamber is filled with lubricant and is pressurized with the fluidic pressure of the outlet cavity because the fluidic resistance between the outlet cavity and the control chamber is relatively high due to the long control chamber channel and the throttle provided in the course of the control chamber channel. It can therefore take 5, 10 or even more than 60 seconds after an engine's cold start until pressurized lubricant is generated by the pump and until the engine is sufficiently lubricated after a cold start of the engine.

In addition to the fact that the engine runs at a high mechanical resistance without sufficient lubrication, the wear of the engine and the danger of jamming are high with non-sufficient lubrication.

SUMMARY

An aspect of the present invention is to provide a mechanical variable lubricant vane pump with immediate functionality right after an engine's cold start.

In an embodiment, the present invention provides a variable lubricant vane pump for providing a pressurized lubricant for an internal combustion engine which includes a pump housing, a pump chamber arranged in the pump housing. The pump chamber comprises a plurality of pump compartments which are configured to rotate from a charge zone to a discharge zone. The pressurized lubricant is discharged from the plurality of pump compartments into an outlet cavity. A control ring is configured to be shiftable and to envelope the pump chamber. A pump rotor comprises a static rotor axis and vanes which are configured to be radially slidable and to rotate in the control ring. The control ring is shiftable with respect to the rotor axis between a high pumping volume position and a low pumping volume position. A pressure control chamber is configured to push the control ring into the high pumping volume direction. The pressure control chamber is loaded with lubricant from the outlet cavity. A control valve is configured to connect or to disconnect the pressure control chamber to a lubricant tank. A pilot chamber is configured to push the control ring into the low pumping volume direction against the pressure control chamber. A pilot chamber channel connects the outlet cavity with the pilot chamber. A control chamber channel directly connects the outlet cavity with the pressure control chamber. A smallest flow cross-section of the control chamber channel is $>1/10$ and $\leq 1/1$ of a smallest flow cross-section of the pilot chamber channel.

BRIEF DESCRIPTION OF THE DRAWINGS

The present invention is described in greater detail below on the basis of embodiments and of the drawings in which.

DETAILED DESCRIPTION

Figure 1:
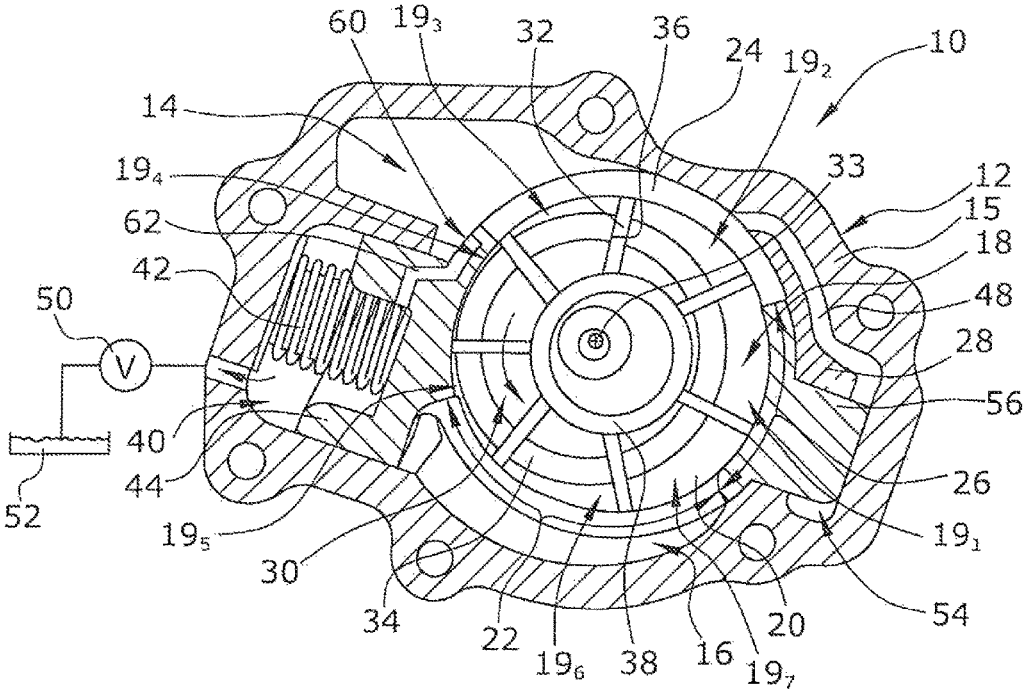
FIG. 1 shows a transversal cross section of a first embodiment of a lubricant vane pump with a control chamber channel provided in the control ring.

In an embodiment of the present invention, the control chamber channel directly connects the outlet cavity with the pressure control chamber so that the fluidic length of the control chamber channel is very short. The control chamber channel has a relatively large cross-section which is larger than 1/10 of the smallest cross-section of the pilot chamber channel providing the pilot chamber with lubricant from the outlet cavity. It can therefore be provided that the control chamber is filled with lubricant and is pressurized with the fluidic pressure of the outlet cavity shortly after an engine's cold start. The control ring is therefore pushed by the control chamber into the high pumping volume direction or into the highest pumping volume position shortly after an engine's cold start. This provides that a high discharge pressure of the lubricant leaving the pump is realized a few seconds after the cold start of the engine so that even at very low lubricant temperatures the lubrication of the engine starts only a few seconds after the engine's cold start at the latest.

In an embodiment of the present invention, the smallest flow cross-section of the control chamber channel can, for example, be larger than ¼, for example, larger than ⅓, and, for example, larger than ½ of the smallest flow cross-section of the pilot chamber channel. The closer the cross-sectional values of the control chamber channel and of the pilot chamber channel are, the more it can be provided that both chambers are filled simultaneously after an engine's cold start. This provides that the control of a stable and sufficient discharge pressure of the lubricant leaving the pump is realized only a few seconds after an engine's cold start. A throttle valve is not provided in the course of the control chamber channel.

In an embodiment of the present invention, the control chamber channel can, for example, be provided as a groove in the control ring. This concept of the control chamber channel is easy to manufacture, and is therefore very cost-effective. Providing the control chamber channel in the body of the control ring allows a control chamber channel with a very short fluidic length to be provided so that the fluidic resistance of the control chamber channel is low.

In an embodiment of the present invention, the control chamber channel can, for example, be provided as a groove in a wall of the pump housing. The control chamber channel can, for example, be provided in the wall separating the outlet chamber from the control chamber. This concept of the control chamber channel can be easy to manufacture, and can also be a cost-effective alternative.

The following is a detailed description of embodiments of the present invention with reference to the drawings.

The drawings show a variable lubricant vane pump 10 being part of a pumping system for supplying an internal combustion engine (not shown) with pressurized lubricant. The lubricant vane pump 10 pumps the lubricant to the combustion engine with a discharge pressure PD and is mechanically driven by the engine so that the rotational speed of the lubricant vane pump 10 is proportional to the rotational speed of the engine.

The lubricant vane pump 10 comprises a pump housing 12 defining a pumping cavity 18, an inlet cavity 16, and an outlet cavity 14. In the pumping cavity 18, a pump rotor 30 with seven radially slidable vanes 32 rotates within a shiftable control ring 28. The vanes 32 are supported and held in vane slits 36 of the pump rotor hub 34. The pump housing 12, the pump rotor 30 and the vanes 32 define seven rotating pump chambers $\mathbf{19}_1$-$\mathbf{19}_7$. In the center of the pump rotor hub 34, a shiftable support ring 38 is provided which supports the radially inward ends of the vanes 32. The pump rotor 30 rotates around a static rotor axis 33 in an anti-clockwise direction.

The seven rotating pump chambers 19 have a pump chamber angle of about 51°. Each pump chamber 19 continuously rotates from a charge zone 22 over the intermediate zone 26 to the discharge zone 24 and back to the charge zone 22. The lubricant is sucked by the rotating pump chamber 19 from the inlet cavity 16 and is delivered to the outlet cavity 14 where the lubricant is pressurized to discharge pressure PD.

Figure 2:
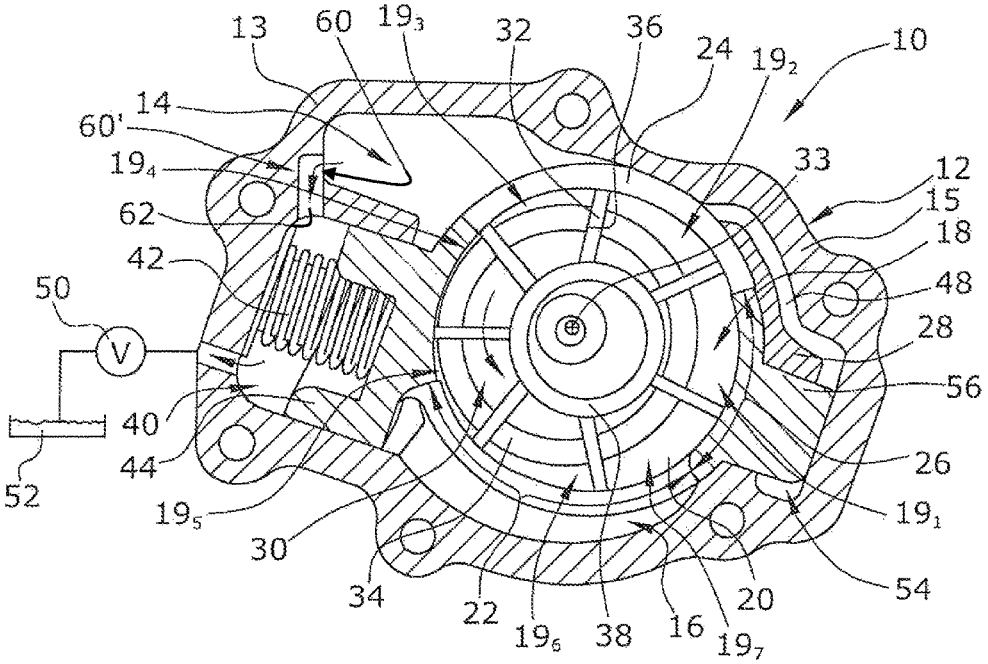
FIG. 2 shows a transversal cross section of a second embodiment of a lubricant vane pump with a control chamber channel provided in a housing wall.

The radial position of the control ring 28 is determined by the fluid pressure in a pressure control chamber 40, the fluid pressure in a pilot chamber 54, and by the force generated by a pretension element 42. The pretension element 42 is provided as a spring arranged inside the pressure control chamber 40. In the shown embodiment, the control ring 28 is linearly shiftable between a high pumping volume position as shown in FIGS. 1 and 2, and a low pumping volume position. In the high pumping volume position, the control ring 28 has a high eccentricity with respect to the rotor axis 33, whereas in the low pumping volume position the eccentricity of the control ring 28 with respect to the rotor axis 33 is small or zero. The pilot chamber 54 as well as the pressure control chamber 40 both are fluidically connected to the outlet cavity 14 via a pilot chamber channel 48 and a control chamber channel 60, 60'. The pilot chamber 54 is not provided with another fluid connection so that the fluidic pressure in the pilot chamber 54 is always a more or less equal to the discharge pressure PD of the outlet cavity 14.

The control ring 28 is provided with a control chamber plunger 44 which is shiftable within the pressure control chamber 40, and with a pilot chamber plunger 56 which is shiftable within the pilot chamber 54. The effective hydraulic surface of the control chamber plunger 44 is higher than the effective hydraulic surface of the pilot chamber plunger 56.

The pressure control chamber 40 is fluidically connected to the atmospheric pressure PA of a lubricant tank 52 via a pressure control valve 50 which is pressure controlled by the discharge pressure PD of the outlet cavity 14. If the pressure control valve 50 is open, the hydraulic pressure in the pressure control chamber 40 depends on the degree of opening of the control valve 50. If the control valve 50 is closed, the hydraulic pressure in the control chamber 40 is equal to the discharge pressure PD of the outlet cavity 14. If the control valve 50 is open, the hydraulic pressure in the control chamber 40 is between the discharge pressure PD and the atmospheric pressure PA.

In the embodiment shown in FIG. 1, the fluidic connection of the control chamber 40 with the outlet cavity 14 is provided by a short control chamber channel 60 which is provided as a groove 62 in body of the control ring 28 and of the connected control chamber plunger 44. The control chamber channel 60 therefore moves together with the control ring 28. An opening orientated to the outlet cavity 14 is provided at one end of the control chamber channel 60, and an opening orientated to the control chamber 40 is provided at the other end of the control chamber channel 60. The cross section of the control chamber channel 60 is more or less constant over its entire length.

The pilot chamber 54 is connected to the discharge pressure PD in the outlet cavity 14 by the pilot chamber channel 48 which is provided in a part of the housing wall 15 of the pump housing 12. The pilot chamber channel 48 has a more or less constant cross-section over its entire length. The cross section of the control chamber channel 60 is about ½ of the cross section of the pilot chamber channel 48.

In the embodiment shown in FIG. 2, the fluidic connection of the pressure control chamber 40 with the outlet cavity 14 is provided by a short control chamber channel 60' which is provided as a groove 62' in the wall 13 of the pump housing 12. The fluidic length of the control chamber channel 60' is short because only the side wall of the pressure control chamber 40 separates the pressure control chamber 40 from the outlet cavity 14. The cross section of the control chamber channel 60' is about ½ of the cross section of the pilot chamber channel 48.

The present invention is not limited to embodiments described herein; reference should be had to the appended claims.

What is claimed is:

1. A variable lubricant vane pump for providing a pressurized lubricant for an internal combustion engine, the variable lubricant vane pump comprising:

a pump housing;

a pump chamber arranged in the pump housing, the pump chamber comprising a plurality of pump compartments which are configured to rotate from a charge zone to a discharge zone, the pressurized lubricant being discharged from the plurality of pump compartments into an outlet cavity;

a control ring configured to be shiftable and to envelope the pump chamber;

a pump rotor comprising a static rotor axis and vanes which are configured to be radially slidable and to rotate in the control ring, the control ring being shiftable with respect to the rotor axis between a high pumping volume position and a low pumping volume position;

a pressure control chamber comprising a pressure control chamber plunger, the pressure control chamber being configured to directly push, via the pressure control chamber plunger, the control ring into a high pumping volume direction, the pressure control chamber being loaded with lubricant from the outlet cavity;

a control valve configured to connect or to disconnect the pressure control chamber to a lubricant tank;

a pilot chamber comprising a pilot chamber plunger, the pilot chamber being configured to directly push, via the pilot chamber plunger, the control ring into a low pumping volume direction against the pressure control chamber;

a pilot chamber channel permanently connecting the outlet cavity with the pilot chamber; and a control chamber channel permanently and directly connecting the outlet cavity with the pressure control chamber, a smallest flow cross-section of the control chamber channel being >1/10 and <1/1 of a smallest flow cross-section of the pilot chamber channel, wherein, the control chamber channel is provided as a groove in the control ring, or the pump housing comprises a wall, and the control chamber channel is provided as a groove in the wall of the pump housing.

2. The variable lubricant vane pump as recited in claim 1, wherein the smallest flow cross-section of the control chamber channel is >1/4 and ≤1/1 of the smallest flow cross-section of the pilot chamber channel.

3. The variable lubricant vane pump as recited in claim 1, wherein the smallest flow cross-section of the control chamber channel is >1/3 and ≤1/1 of the smallest flow cross-section of the pilot chamber channel.

4. The variable lubricant vane pump as recited in claim 1, wherein the smallest flow cross-section of the control chamber channel is >1/2 and ≤1/1 of the smallest flow cross-section of the pilot chamber channel.

5. The variable lubricant vane pump as recited in claim 1, further comprising a mechanical pretension element configured to push the control ring into the high pumping volume direction.

6. The variable lubricant vane pump as recited in claim 5, wherein the mechanical pretension element is a spring arranged inside the pressure control chamber.

7. The variable lubricant vane pump as recited in claim 1, wherein a cross-section of the control chamber is greater than a cross-section of the pilot chamber.

* * * * *